United States Patent [19]

Mussoni et al.

[11] 4,196,044

[45] Apr. 1, 1980

[54] PRODUCT AND PROCESS FOR MAKING A CREPED AND CALENDERED CELLULOSIC ELECTRICAL PAPER

[75] Inventors: Frank L. Mussoni, Sudbury, Mass.; Gary A. Withrow, Erlanger, Ky.

[73] Assignee: Dennison Manufacturing Company, Framingham, Mass.

[21] Appl. No.: 905,266

[22] Filed: May 12, 1978

Related U.S. Application Data

[63] Continuation-in-part of Ser. No. 655,654, Feb. 5, 1976, abandoned.

[51] Int. Cl.[2] ..... D21H 5/24

[52] U.S. Cl. ..... 162/112; 162/113; 162/138; 162/158; 162/206; 427/121; 428/153

[58] Field of Search ..... 162/138, 157 C, 113, 162/158, 112, 206, 111, 205; 428/153; 174/137 B; 427/121

[56] References Cited

U.S. PATENT DOCUMENTS

| | | | |
|---|---|---|---|
| 1,676,759 | 7/1928 | Widmer | 162/113 |
| 1,805,013 | 5/1931 | Sayler | 162/112 |
| 3,102,159 | 8/1963 | Ford | 162/138 |
| 3,149,025 | 9/1964 | Dickens | 162/206 |
| 3,170,027 | 2/1965 | Ford | 162/138 |
| 3,316,178 | 4/1967 | Millington | 162/138 |
| 3,469,219 | 9/1969 | Berg et al. | 162/138 |
| 3,640,841 | 2/1972 | Winslow et al. | 162/112 |
| 3,728,465 | 4/1973 | Yasui et al. | 162/138 |

FOREIGN PATENT DOCUMENTS

| | | | |
|---|---|---|---|
| 883699 | 12/1961 | United Kingdom | 162/138 |

OTHER PUBLICATIONS

Casey, "Pulp and Paper" vol. III, (1961), pp. 1275, 1276, 1464–1473.

*Primary Examiner*—S. Leon Bashore
*Assistant Examiner*—Peter Chin
*Attorney, Agent, or Firm*—George E. Kersey

[57] ABSTRACT

A process for producing cellulosic products which are particularly suitable for use as electrical insulators. The product is produced by creping base paper or stock and thereafter calendering the paper so that its final density is equal or greater than its starting density. The resulting creped product desirably has a density in the range from 0.8 to 1.2 grams per cubic centimeter, an increased Gurley densometer reading and has such mechanical and electrical properties as flexibility, extensibility and insulative effect.

17 Claims, No Drawings

PRODUCT AND PROCESS FOR MAKING A CREPED AND CALENDERED CELLULOSIC ELECTRICAL PAPER

BACKGROUND OF THE INVENTION

This is a continuation-in-part of Ser. No. 655,654, filed Feb. 5, 1976 now abandoned. The application relates to a method of treating cellulosic products such as paper, whereby the final density of said product is unexpectedly the same or greater than its starting density. Thus, the physical characteristics of the cellulosic products in accordance with this invention are particularly well suited for use as transformer turns insulating material but are not limited to such use.

The most important component in every transformer is the individual winding turn which can be composed of numerous parallel conductors. For numerous reasons, these conductors must be insulated from each other. Within the same turn, the insulation on individual conductors reduces circulating currents and keeps losses to a reasonable range. Thus, the physical properties of conductor insulation are important if the maximum amount of energy is to be conserved.

Since the energy requirements of this country are extremely high, the windings required by units able to handle excessively high operating voltages have, of necessity been very large, heavy, complicated and very difficult to handle during the manufacture and shipping processes.

In an attempt to alleviate at least some of these problems, insulating paper of the rope-kraft variety is most commonly employed at present. Although this kind of paper is generally satisfactory, it tends to be deficient where thin insulation is required for irregular coil and magnet wire configurations. In that event the paper tends to gap or tear when the wire or surface on which it is wound is bent into shape.

Ideally, a method of treating cellulosic materials whereby the resultant product has high dielectric strength and adequate mechanical strength to withstand the forces generated during coil winding, conductor transposing, winding assembly and transformer shipping would be beneficial to the industry. In addition, and more generally, a method of treating these materials such that the resultant product exhibits the properties of toughness and strength but at the same time is thin and extreme flexibility would be of virtually limitless advantage to both the industry and consumer for a wide variety of purposes. This invention affords a method of producing such a product by providing a novel method of creping and calendering base stock to a final and unexpectedly high density while imparting a desirable pliability to said product.

SUMMARY OF THE INVENTION

The cellulosic products in accordance with the present invention are high in density and are unusually thin and flexible. However, they have comparable tensile and tear strengths, have greatly improved stress-strain characteristics and, among other numerous advantages, have a high dielectric strength on taped conductor which is a considerable improvement over that currently available in other cellulosic sheets. This is accomplished by a unique method of creping and densification such that the final product has a density equal to or greater than its original density. Since the general manufacture of creped paper results in a decrease in density of as much as 100 percent with an accompanying substantial increase in bulk, the novel method of this invention provides a totally new concept in creped paper products.

Generally, the method comprises treating the base stock to render it malleable, increasing its mass per unit area and thereafter increasing its mass per unit volume to or beyond the density of the base stock, but short of the point which causes degradation of the material. More particularly, the base stock, which in most instances will be a cellulose base sheet, is first wetted with a liquid having a substantially neutral pH in order to soften the sheet and make it more pliable. The wetted sheet material is then treated with a creping compound. This should essentially be a material(s) capable of affecting adhesion of the base sheet to a creping roll while, at the same time, permitting the base sheet to be crimped by a doctor blade employed with the creping roll. Any residual liquid is then removed from the sheet material while the temperature is simultaneously raised to a point sufficient to impart pliability. At the same time, the span of the sheet for a given mass of material is reduced while the sheet is simultaneously compressed. Compression of the treated sheet can be carried out over a relatively wide range. It should be accomplished, however, at pressures which are sufficient to maintain substantially the initial average thickness of the base sheet while at the same time maintaining substantially the same density in the final product as in the initial base sheet or increasing the density over its initial value. The mass per unit area is thus increased by essentially plicating the treated stock and then compressing it in order that the mass per unit volume be increased. The creped product derived has a density and bulk which is at least substantially the same as for the base sheet before creping and has a relatively smooth surface in addition to being able to conform to irregular surfaces.

The products in accordance with the present invention can be made from a variety of known starting materials to be used as the base stock. Generally, starting materials include any known papers whether prepared by cylinder or Fourdrinier methods, so long as the starting material possesses a density of about 0.8, a thickness in a range of from about 0.0025 inch to 0.0045 inch and the ability to be creped. Moreover, although papers containing natural fibers are preferred, those containing synthetic fibers or blends or mixtures of both natural and synethetic fibers may be used so long as they do not adversely affect the desired physical and electrical properties. Consequently, it is to be understood in this regard that the term "cellulosic material" includes materials containing natural and synthetic fibers as well as blends of the same.

In carrying out the process, a wide variety of wetting and/or softening compounds can be used, so long as they have a substantially neutral pH. Exemplary compounds are water, mixtures of water and solvents miscible with water, such as the lower primary alcohols including methyl, ethyl, propyl and butyl alcohol, and the like. In this connection it is noted that with higher density materials, i.e., base stock having a density of about 0.7 or more it is desirable that the base stock undergo a pre-wetting step as well. However, the above-mentioned softeners are employed.

As with the softening agents, it is possible to employ a wide variety of creping compounds. Generally, such creping materials include naturally occurring and synthetic adhesive materials which do not adversely affect the properties of the final product. Exemplary creping compounds are casein, animal glues, starch, dextrine, carboxy methyl cellulose, and the like. However, the preferred creping compound is carboxy methyl cellulose alone (hereinafter referred to as CMC) which is similar in its properties to cellulosic sheet material. Most preferably, medium viscosity CMC is employed. Low or high viscosity CMC may be used, however, for it is the degree of solids which may be put into the creping compound which is important. It is essentially for reasons of ease of handling that CMC-medium viscosity is preferred.

Although this invention has thus far and in the ensuing detailed description will continue to be described primarily in terms of its particular suitability to the field of electrical turns insulation, it is to be understood that the products of the invention can be employed any place where a relatively strong but thin, flexible, extensible paper is desirable. In addition, when employed as an electrical insulator, the product can be treated with one or more nitrogen-donor compounds in order to slow the degradation of the material when subject to electrical, thermal, and physical stresses over long periods of time. Such nitrogen-donor compounds may be applied to the cellulosic insulating product by spraying, dipping or passing the product through a bath. Among such nitrogen-donor compounds which can be used are dicyanodiamide, triethanolamine, melamine, acrylonitrile, and similar materials.

Among its other advantages the cellulosic material of this invention and the process for making it can be carried out using commercially available equipment. For example, such equipment as pre-wetters, creping rolls, creping blades, driers, calenders, slitters and the like. Generally, such apparatus includes a pre-wetting device, a smooth supporting creping roll, a creping blade and apparatus such as a dryer, calender and slitter arranged in the manner in which they are normally employed in the process of creping materials.

In order that the present invention be more clearly understood, reference will now be made to the following detailed description which sets forth the parameters of this invention.

DETAILED DESCRIPTION

The present invention contemplates wetting the base stock having a density of between about 0.75 to 0.9 grams/cubic centimeter, a Gurley densometer reading in the range of about 500–1500 seconds, and a thickness in the range of about 0.0025 to about 0.0045 inches with one or more of the previously mentioned softening agents. This is accomplished while subjecting said base stock to a temperature in the range of from about 50° F. to about the boiling point of the softening agent employed. The wetted sheet is contacted with a creping compound, preferably CMC (medium viscosity) in an amount sufficient to cause the sheet to adhere to the creping roll while permitting the doctor blade employed in conjunction with the roll of crimp the sheet. A portion of the liquid is removed from the sheet while the temperature is raised to from about 120° F. to about 190° F. such that the sheet is pliable. The span of the sheet is reduced for a given mass of material and is then compressed. The pressures employed are generally in a range of from about 200 pounds per linear inch to about 600 pounds per linear inch; preferably pressures in the range of 300–500 pounds per linear inch are employed. The resultant product exhibits a density which is virtually the same or greater than that of the starting material; that is, a flat cellulosic base sheet and a thickness or bulk which remains substantially unchanged from that of the starting material. More specifically, the product desirably has a density in a range of from about 0.80 gram per cubic centimeter to about 1.2 grams per cubic centimeter, a Gurley densometer reading in the range from about 1000 to 10,000 seconds, an elongation in a range of from about 10 percent to about 40 percent, an average thickness in a range from about 0.0025 inch to about 0.0045 inch, a machine direction tensile strength in a range of from about 20 pounds per inch to about 50 pounds per inch, a Finch edge machine direction tear in a range of from about 10 pounds to about 25 pounds, a toughness value in a range of from about 20 foot pounds per square foot to about 55 foot pounds per square foot and a Mullen Burst Strength in the range of from about 25 pounds per square inch to about 50 pounds per square inch. In the preferred embodiment of this invention, the cellulosic product, for example, kraft paper, exhibits a density in the range of from 0.8 gram per cubic centimeter to about 0.9 gram per cubic centimeter and most preferably about 0.85 gram per cubic centimeter. The degree of elongation is preferably 15% to 30% and most desirably about 15% to 25%. The product preferably has a thickness measuring about 0.0030 inch with the toughness value measuring from about 25 to 55 foot pounds per square foot. The tensile strength of the product is preferably in the range of from about 25 to about 45 pounds per inch with 25 pounds per inch being most preferred. The Finch edge machine direction tear is preferably in the range of about 15 pounds to about 25 pounds with greater than 20 pounds being the optimum reading. Lastly, the Mullen Burst Strength is preferably in the range of about 30 psi to about 45 psi with 35 psi considered optimum.

The significance of the above readings rests, as mentioned previously, in the fact that in the conventional manufacture of creped paper, the density is decreased as much as 100 percent with an accompanying substantial increase in bulk. In contrast, as mentioned hereinabove, the product of the present invention exhibits a density which can be practically the same as that of the starting materials; that is, a flat cellulosic base sheet, and a thickness or bulk which can be substantially unchanged from that of the starting material. The Gurley densometer reading is increased from a range of 500 to 1500 seconds to a range of 1000 to 10,000 seconds. At the same time, the product has a smooth surface, a fairly extensive elongation and elasticity, and the ability to conform snugly to irregular surfaces, without gapping or tearing. This is by contrast with presently known insulation materials. In addition, a comparison of the virtual toughness and strength of the inventive product as compared to such known insulation materials yields the following unexpected result: a 1 inch wide conventional creped paper product requires less than 2 pounds of load to pull out the first 5% of stretch. In contrast the new cellulosic product requires more than 10 pounds of load to pull out the first 3% of stretch; clearly not a difference in degree but in kind.

As further evidence of their novel properties, a cellulosic insulating product of this invention was tested in oil-filled transformers and in automotive electrical coils. The product tested had a density of 0.95 gram per cubic centimeter, an elongation of about 15 percent to 25 percent, a thickness of about 0.0030 inch, a machine direction tensile strength of about 25 pounds per inch, a Finch edge machine direction tear of about 18 pounds, a toughness value of 35 foot pounds per square foot, and a Mullen Burst Strength of about 40 pounds per square inch made from creped paper having an initial density of about 0.9 gram per cubic centimeter and an average thickness of 0.0030 inch.

The product performed excellently under conventional operating conditions. Furthermore, when such a material was wrapped in a butt-layer relationship around magnetic wire of small diameter, the elasticity properties of the paper acted to substantially eliminate any chance of gap formation, tearing and the like. In addition, when the product of the invention was applied in C-formed overlapped configuration to small-diameter coil wire, the assembled product could be bent and/or twisted into various configurations without gaps being formed in the turn insulation or any other damage thereto. However, normally-employed flat insulating material not exhibiting the elasticity and stretchability or the strength of the product of the present invention cannot be so manipulated without evidence of gapping and tearing and the like and, consequently, the distinct possibility of physical damages being incurred during subsequent manufacturing and assembly operations which could lead to short circuiting when in actual use.

In order to determine the degree of improvement in the insulating properties of the cellulosic products of this invention a comparison was made between the air porosity through a web of the untreated base paper and that of the paper creped in accordance with the present invention. A 40 inch width of paper was employed through which was injected at 11 different points, 100 cubic centimeters of air going through a 1 square inch orifice with 20 ounces of pressure being employed. The following Gurley densometer readings were obtained:

Table 1

RELATIONSHIP OF CURLEY DENSOMETER TO POINT OF PROCESS

| Pt. of Process | POSITION ON ROLL 1 | 2 | 3 | 4 | 5 | 6 | 7 | 8 | 9 | 10 | 11 |
|---|---|---|---|---|---|---|---|---|---|---|---|
| Base Paper | 814 | 758 | 654 | 695 | 644 | 673 | 631 | 553 | 579 | 600 | 558 |
| FINAL PRODUCT | 2777 | 2438 | 2494 | 2538 | 2236 | 1615 | 2168 | 2331 | 1762 | 2024 | 3023 |

Average:
BASE PAPER - 651
FINAL PRODUCT - 2319

The numerical values given above to describe various physical properties were obtained by following the widely recognized and accepted methods of the American Society for Testing and Materials and the Technical Association of the Pulp and Paper Industry—specifically these are as follows:

| | | |
|---|---|---|
| Density | A.S.T.M. | D202-72a Wet Basis |
| Elongation | A.S.T.M. | D202-72a D828 |
| Thickness | A.S.T.M. | D202-72a Method D |
| M.D. Tensile Strength | A.S.T.M. | D202-72a D828 |
| Pinch Edge Tear | A.S.T.M. | D827-71 |
| Touchness (Tensile Energy Absorption) | T.A.P.P.T. | T494-05-70 |
| Mullen Burst Strength | A.S.T.M. | D774-71 |

As is evident from the data set forth in Table I, as the value increased, the rate of air passage dramatically decreased indicating that the sheet became progressively tighter. This is due to the fact that the paper product has a relatively smooth surface, is thin and is extremely flexible which allows it to conform snugly to even irregular surfaces. It is in fact so thin that it can withstand electrical stress in excess of 150,000 volts depending upon the number of turns around, for example the magnet wire.

Numerous other advantages of the products of this invention, the method or process for their manufacture and their use, will be readily apparent to those skilled in the art. Accordingly, it is to be understood that this invention is not to be limited to the enclosed embodiments set forth herein except as defined in the appended claims.

What is claimed is:

1. A process for manufacturing an electrically insulating paper product, comprising the steps of
   (a) moistening a cellulosic base paper member having a density of at least about 0.75 gm/cm$^3$ and a Gurley densometer value in the range of about 500–1500 seconds;
   (b) creping said paper base member to increase the mass per unit area to form an intermediate member; and
   (c) calendering the intermediate member to increase the mass per unit volume to at least or greater than that of said base member without degradation such that the Gurley densometer value has a range of about 1000–10,000 seconds and wherein the calendered member has an elongation of at least about 10%.

2. The process of claim 1 wherein said moistening step includes wetting said base member with a liquid having a substantially neutral pH to a point where said base member is softened, while said base member is simultaneously subjected to a temperature of from about 50° F. to about the boiling point of said liquid.

3. The process of claim 2 wherein said liquid is selected from the group consisting of water, solvents miscible in water and combinations thereof.

4. The process of claim 3 wherein said solvents are selected from the group consisting of lower primary alcohols.

5. The process of claim 2 wherein the resultant wetted sheet is contacted with a creping compound in an amount sufficient to cause the sheet to adhere to the creping roll while permitting the doctor blade employed in conjunction with the roll to crimp the sheet.

6. The process of claim 5 wherein the creping compound is selected from the group consisting of casein, animal glues, starch, dextrin and carboxymethyl cellulose.

7. The process of claim 6 wherein the creping compound is carboxymethyl cellulose.

8. The process of claim 5 wherein the temperature is raised to from about 120° F. to about 190° F. while a portion of the residual liquid is removed.

9. The process of claim 6 wherein calendering said intermediate member is accomplished at a pressure range of from about 200 to about 600 pounds per linear inch.

10. The process of claim 7 wherein pressures in the range of about 300 to about 500 pounds per linear inch are employed.

11. The process of claim 1 wherein said calendered, creped base member has a density of between about 0.8 and about 1.2 gram per centimeters and a thickness in the range of about 0.0025 to about 0.0045 inches.

12. The product of the process of claim 1.

13. A cellulosic product according to claim 12 having a density in the range from about 0.80 gram to about 1.2 grams per cubic centimeter.

14. The product of claim 13 having an elongation in the range of about 10% to about 40%, a thickness in the range of about 0.0025 to about 0.0045 inch, a machine direction tensile strength in the range of about 20 to 50 pounds per inch, a Finch edge machine direction tear in the range of from about 10 to 25 pounds, a toughness value in the range of about 20 to 55 pounds per square foot and a Mullen Burst Strength in the range of about 25 to 50 psi.

15. The product of claim 13 having a density of 0.90 to 1.0 gram per cubic centimeter, elongation in the range of about 15 to about 30%, a thickness of 0.0030 inch, a toughness of about 25 to about 55 pounds per square foot, a tensile strength of about 25 to about 45 pounds per inch, a Finch edge machine direction tear of about 15 to about 25 pounds and a Mullen Burst Strength of about 30 to about 45 psi.

16. The product of claim 15 having a density of about 0.95 gram per cubic centimeter, an elongation of about 15% to about 25%, a tensile strength of about 25 pounds per inch, a Finch edge machine direction tear of about 15 to about 20 pounds and a Mullen Burst Strength of about 35 psi.

17. The product of claim 13 wherein the product is impregnated with at least one nitrogen-donor compound selected from the class including dicyanodiamide, triethanolamine, melamine, and acrylonitrile.

* * * * *